US012448103B2

(12) United States Patent
Fukui

(10) Patent No.: US 12,448,103 B2
(45) Date of Patent: Oct. 21, 2025

(54) PROPELLER PROPULSION APPARATUS FOR SHIP

(71) Applicant: HONDA MOTOR CO., LTD., Tokyo (JP)

(72) Inventor: Takahiro Fukui, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 216 days.

(21) Appl. No.: 18/373,990

(22) Filed: Sep. 28, 2023

(65) Prior Publication Data

US 2024/0109634 A1 Apr. 4, 2024

(30) Foreign Application Priority Data

Sep. 29, 2022 (JP) ..... 2022-156963

(51) Int. Cl.
*B63H 21/21* (2006.01)
*B63H 20/00* (2006.01)

(52) U.S. Cl.
CPC ..... *B63H 21/21* (2013.01); *B63H 2020/003* (2013.01); *B63H 2021/216* (2013.01)

(58) Field of Classification Search
CPC ..... B63H 21/21; B63H 2020/003; B63H 2021/216; B63H 5/08; B63H 2021/205; B63H 21/17
See application file for complete search history.

(56) References Cited

U.S. PATENT DOCUMENTS 6,322,406 B1 * 11/2001 Griffith, Sr. ..... B63H 5/08 440/6
9,090,321 B1 * 7/2015 Casperson ..... B63H 5/08
2008/0090475 A1 * 4/2008 Mizokawa ..... B63H 21/22 440/86
2009/0293795 A1 * 12/2009 Schroder ..... B63H 23/24 114/338
2015/0307176 A1 * 10/2015 Nakayasu ..... B63H 20/12 701/21
2022/0242540 A1 * 8/2022 Honda ..... B63H 23/30
2023/0020778 A1 * 1/2023 Sawano ..... B63H 23/30
2023/0415871 A1 * 12/2023 Koga ..... B63H 20/14

FOREIGN PATENT DOCUMENTS

JP 2009-190673 8/2009
JP 2015-202853 11/2015

* cited by examiner

*Primary Examiner* — Richard M Camby
(74) *Attorney, Agent, or Firm* — Amin, Turocy & Watson, LLP

(57) ABSTRACT

This propeller propulsion apparatus for a ship includes a first propeller, a second propeller disposed coaxially with the first propeller and rotating in a direction opposite to the first propeller, a first electric motor configured to drive the first propeller, a second electric motor configured to drive the second propeller, a control unit configured to control each of the first electric motor and the second electric motor, and a memory unit configured to store a combination of rotational frequencies of the first propeller and the second propeller at each vessel speed where total power consumption of the first electric motor and the second electric motor is an optimum value, and the control unit controls the first electric motor and the second electric motor on the basis of the data of the memory unit such that the total power consumption at each vessel speed is the optimum value during an operation of a ship.

16 Claims, 5 Drawing Sheets

| Vessel speed kph | Fr Prop Rotational frequency rpm | Rr Prop Rotational frequency rpm | Total power consumption kW | Efficiency |
|---|---|---|---|---|
| 10kph | 1000 | 1200 | 40 | — |
| 10kph | 1000 | 1100 | 39 | — |
| 10kph | 1000 | 1000 | 38 | — |
| 10kph | 1000 | 900 | 37 | ○ |

PROPELLER PROPULSION APPARATUS FOR SHIP

CROSS-REFERENCE TO RELATED APPLICATION

The present application claims priority based on Japanese Patent Application No. 2022-156963, filed Sep. 29, 2022, the content of which is incorporated herein by reference.

BACKGROUND OF THE INVENTION

Field of the Invention

The present invention relates to a propeller propulsion apparatus for a ship.

Description of Related Art

As a propeller propulsion apparatus for a ship, a contra-rotating propeller in which a front propeller rotating in one direction and a rear propeller rotating in a direction opposite to the front propeller are disposed coaxially is known (for example, see Japanese Unexamined Patent Application, First Publication No. 2009-190673, and Japanese Unexamined Patent Application, First Publication No. 2015-202853).

In the contra-rotating propeller disclosed in Japanese Unexamined Patent Application, First Publication No. 2009-190673 and Japanese Unexamined Patent Application, First Publication No. 2015-202853, the front propeller and the rear propeller are disposed coaxially, and these propellers receive a driving force of an engine and rotate in opposite directions. Such a contra-rotating propeller negates a swirling flow produced by the front propeller with a reverse swirling flow produced by the rear propeller.

Accordingly, in the contra-rotating propeller, the swirling flow produced by the front propeller can be collected by the rear propeller, and the driving force can be efficiently used as propulsion power of the ship.

SUMMARY OF THE INVENTION

The propeller propulsion apparatus (contra-rotating propeller) in the related art distributes a driving force of the engine to the front and rear propellers using a gear mechanism. For this reason, the front propeller and rear propeller are always rotated at a constant speed or a constant speed ratio. Therefore, depending on a vessel speed of the ship, the driving force generated by the engine may not be used as efficiently.

In recent years, as the driving source of the propeller propulsion apparatus, an electric motor has been used instead of the engine in some cases. Using the electric motor as the driving source in the propeller propulsion apparatus using the above-mentioned contra-rotating propeller is considered as well. However, in this case, like the propeller propulsion apparatus in the related art, when the front propeller and the rear propeller are always rotated at a constant speed or at a constant speed ratio, the driving force of the electric motor cannot be used as efficiently depending on the vessel speed of the ship. Then, when the driving force of the electric motor cannot be used as efficiently, power consumption of the battery increases, and a marine navigation distance of the ship is shortened.

In addition, as the propeller propulsion apparatus, a double propeller is known in which two front and rear propellers that rotate synchronously in the same direction are connected with a rotation phase shifted by a certain angle. The propeller propulsion apparatus rectifies a swirling flow generated by the front propeller by rotating the rear propeller whose rotation phase is shifted from that of the front propeller.

Even in the case of the propeller propulsion apparatus using such a double propeller, like the above-mentioned contra-rotating propeller, the driving force may not be used as efficiently depending on the vessel speed of the ship. For this reason, even in such a propeller propulsion apparatus, when the electric motor is used as the driving source, there is concern that power consumption of the battery will increase depending on the vessel speed of the ship.

Here, an aspect of the present invention is directed to providing a propeller propulsion apparatus for a ship capable of efficiently using a driving force of an electric motor regardless of a vessel speed of a ship.

In order to accomplish the above-mentioned purposes, a propeller propulsion apparatus for a ship according to an aspect of the present invention employs the following configurations.

(1) A first aspect of the present invention includes a first propeller (for example, a first propeller (16F) of an embodiment); a second propeller (for example, a second propeller (16S) of the embodiment) disposed coaxially with the first propeller and rotating in a direction opposite to the first propeller; a first electric motor (for example, a first electric motor (11F) of the embodiment) configured to drive the first propeller; a second electric motor (for example, a second electric motor (11S) of the embodiment) configured to drive the second propeller; a control unit (for example, a control unit (14) of the embodiment) configured to control each of the first electric motor and the second electric motor; and a memory unit (for example, a memory unit (25) of the embodiment) configured to store a combination of rotational frequencies of the first propeller and the second propeller at each vessel speed where total power consumption of the first electric motor and the second electric motor is an optimum value, and the control unit controls the first electric motor and the second electric motor on the basis of the data of the memory unit such that the total power consumption at each vessel speed is the optimum value during operation of a ship.

In the aspect of the above-mentioned (1), a combination of rotational frequencies of the first propeller and the second propeller at each vessel speed where total power consumption of the first electric motor and the second electric motor is an optimum value (for example, minimum value) is stored in the memory unit by data collection or the like during a calibration operation of the ship. During normal marine navigation of the ship, the combination of the rotational frequencies of the first propeller and the second propeller appropriate for a target speed of the ship is selected on the basis of the stored data of the memory unit, and the first electric motor and the second electric motor are controlled by the control device. As a result, rotation of each propeller is controlled such that the total power consumption of the first electric motor and the second electric motor is the optimum value according to a marine navigation speed of the ship.

(2) In the aspect of the above-mentioned (1), the optimum value may be a value equal to or smaller than a previously set threshold.

(3) The aspect of the above-mentioned (1) or (2) may further include an operation control device (for example, an operation control device (18) of the embodiment) configured to control the operation of the ship, the operation control device may have a calibration operation mode of calibrating the combination of the rotational frequencies of the first propeller and the second propeller at each vessel speed where the total power consumption is an optimum value and storing the combination in the memory unit; and a normal operation mode of causing the control unit to control the first electric motor and the second electric motor on the basis of the data of the memory unit such that the total power consumption is an optimum value at each vessel speed, and the operation control device may be switched between the normal operation mode and the calibration operation mode according to an operation situation of the ship.

According to the aspect of the above-mentioned (3), for example, the mode is switched from the normal operation mode to the calibration operation mode when there is no safety problem with the calibration operation of the ship. Accordingly, the calibration data of the combination of the rotational frequencies of the first propeller and the second propeller can be collected while ensuring safe operation of the ship.

(4) In the aspect of the above-mentioned (3), the operation control device may be switched from the normal operation mode to the calibration operation mode when at least one of the first propeller and the second propeller is replaced.

According to the aspect of the above-mentioned (4), when at least one of the first propeller and the second propeller is replaced, the combination of the rotational frequencies of the first propeller and the second propeller where the total power consumption of the first electric motor and the second electric motor is the optimum value is changed. For this reason, by being switched to the calibration operation mode at timing when at least one of the first propeller and the second propeller is replaced, a normal operation can be performed by changing the calibration data of the combination of the rotational frequencies of the first propeller and second propeller to the latest one.

(5) In the aspect of the above-mentioned (3) or (4), the operation control device may be periodically switched from the normal operation mode to the calibration operation mode.

According to the aspect of the above-mentioned (5), by being periodically switched from the normal operation mode to the calibration operation mode, normal operation can be performed by changing the calibration data of the combination of the rotational frequencies of the first propeller and second propeller to the latest one.

(6) A second aspect of the present invention has a first propeller (for example, a first propeller (16F) of the embodiment); a second propeller (for example, a second propeller (16S) of the embodiment) disposed coaxially with the first propeller and rotating in a direction opposite to the first propeller; a first electric motor (for example, a first electric motor (11F) of the embodiment) configured to drive the first propeller; a second electric motor (for example, a second electric motor (11S) of the embodiment) configured to drive the second propeller; a battery (for example, a battery (19) of the embodiment) configured to supply electric power to the first electric motor and the second electric motor; a control unit (for example, a control unit (14) of the embodiment) configured to control the first electric motor and the second electric motor; and a memory unit (for example, a memory unit (25) of the embodiment) configured to store a combination of rotational frequencies of the first propeller and the second propeller at each vessel speed and a remaining capacity of the battery where total power consumption of the first electric motor and the second electric motor is an optimum value, and the control unit controls the first electric motor and the second electric motor on the basis of the data of the memory unit such that the total power consumption is an optimum value at each vessel speed and remaining capacity of the battery of a ship during operation of the ship.

In the aspect of the above-mentioned (6), the combination of the rotational frequencies of the first propeller and the second propeller at each vessel speed and remaining capacity of the battery where total power consumption of the first electric motor and the second electric motor is an optimum value (for example, minimum value) is stored in the memory unit by data collection or the like during a calibration operation of the ship. The combination of the rotational frequencies of the first propeller and the second propeller appropriate for a target speed of the ship and the current remaining battery capacity on the basis of the stored data of the memory unit during normal marine navigation of the ship are selected, and the first electric motor and the second electric motor are controlled by the control device. As a result, rotation of each propeller is controlled such that total power consumption of the first electric motor and the second electric motor is an optimum value according to the marine navigation speed of the ship and the current remaining battery capacity.

(7) In the aspect of the above-mentioned (6), the optimum value may be a value equal to or smaller than a previously set threshold.

(8) A third aspect of the present invention includes a first propeller (for example, a first propeller (116F) of the embodiment); a second propeller (for example, a second propeller (116S) of the embodiment) disposed coaxially with the first propeller and synchronizedly rotated in the same direction as the first propeller; an electric motor (for example, an electric motor (111) of the embodiment) configured to drive the first propeller and the second propeller; a phase operation actuator (for example, a phase operation actuator (40) of the embodiment) configured to adjust a rotation phase difference between the first propeller and the second propeller; a control unit (for example, a control unit (114) of the embodiment) configured to control the electric motor and the phase operation actuator; and a memory unit (for example, a memory unit (25) of the embodiment) configured to store a rotation phase difference between the first propeller and the second propeller at each vessel speed where power consumption of the electric motor is an optimum value, and the control unit controls the phase operation actuator on the basis of data of the memory unit such that the power consumption is an optimum value at each vessel speed during an operation of a ship.

In the aspect of the above-mentioned (8), a rotation phase difference between the first propeller and the second propeller at each vessel speed where power consumption of the electric motor is an optimum value (for example, minimum value) is stored in the memory unit by data collection or the like during a calibration operation of the ship. During normal marine navigation of the ship, the rotation phase difference between the first propeller and the second propeller appropriate for a target speed of the ship is selected on the basis of the stored data of the memory unit, and the phase operation actuator is controlled by the control device. As a result, the rotation phase difference between the first propeller and the second propeller is adjusted such that power consumption of the electric motor is an optimum value according to the marine navigation speed of the ship.

(9) In the aspect of the above-mentioned (8), the optimum value may be a value equal to or smaller than a previously set threshold.

(10) The aspect of the above-mentioned (8) or (9) may further include an operation control device configured to control an operation of the ship, the operation control device may have a calibration operation mode of storing a rotation phase difference between the first propeller and the second propeller at each vessel speed where power consumption of the electric motor is an optimum value in the memory unit; and a normal operation mode of causing the control unit to control the phase operation actuator on the basis of data of the memory unit such that the power consumption is the optimum value at each vessel speed, and the operation control device may be switched between the normal operation mode and the calibration operation mode according to an operation situation of the ship.

According to the aspect of the above-mentioned (10), for example, the mode is switched from the normal operation mode to the calibration operation mode in an operational environment where there is no safety problem with calibration driving of the ship. Accordingly, the calibration data of the rotation phase difference between the first propeller and the second propeller can be collected while ensuring safe operation of the ship.

According to the aspect of the above-mentioned (1), during the operation of the ship, the control unit controls the first electric motor and the second electric motor on the basis of the data of the combination of the rotational frequencies of each propeller at each vessel speed stored in the memory unit. For this reason, when the propeller propulsion apparatus according to the aspect is employed, a driving force of the electric motor can be efficiently used regardless of the vessel speed of the ship.

According to the aspect of the above-mentioned (6), during the operation of the ship, the control unit controls the first electric motor and the second electric motor on the basis of the data of the combination of the rotational frequencies of each propeller at each vessel speed and remaining battery capacity stored in the memory unit. For this reason, when the propeller propulsion apparatus according to the aspect is employed, a driving force of the electric motor can be efficiently used regardless of the vessel speed of the ship and the remaining capacity of the battery.

According to the aspect of the above-mentioned (8), during the operation of the ship, the control unit controls the phase operation actuator on the basis of the data of the rotation phase difference at each vessel speed stored in the memory unit. For this reason, when the propeller propulsion apparatus according to the aspect is employed, a driving force of the electric motor can be efficiently used regardless of the vessel speed of the ship.

DESCRIPTION OF EMBODIMENTS

Hereinafter, embodiments of the present invention will be described with reference to the accompanying drawings. Further, in the embodiments described below, the same components are designated by the same reference signs, and overlapping description thereof may be partially omitted.

First Embodiment

Figure 1:
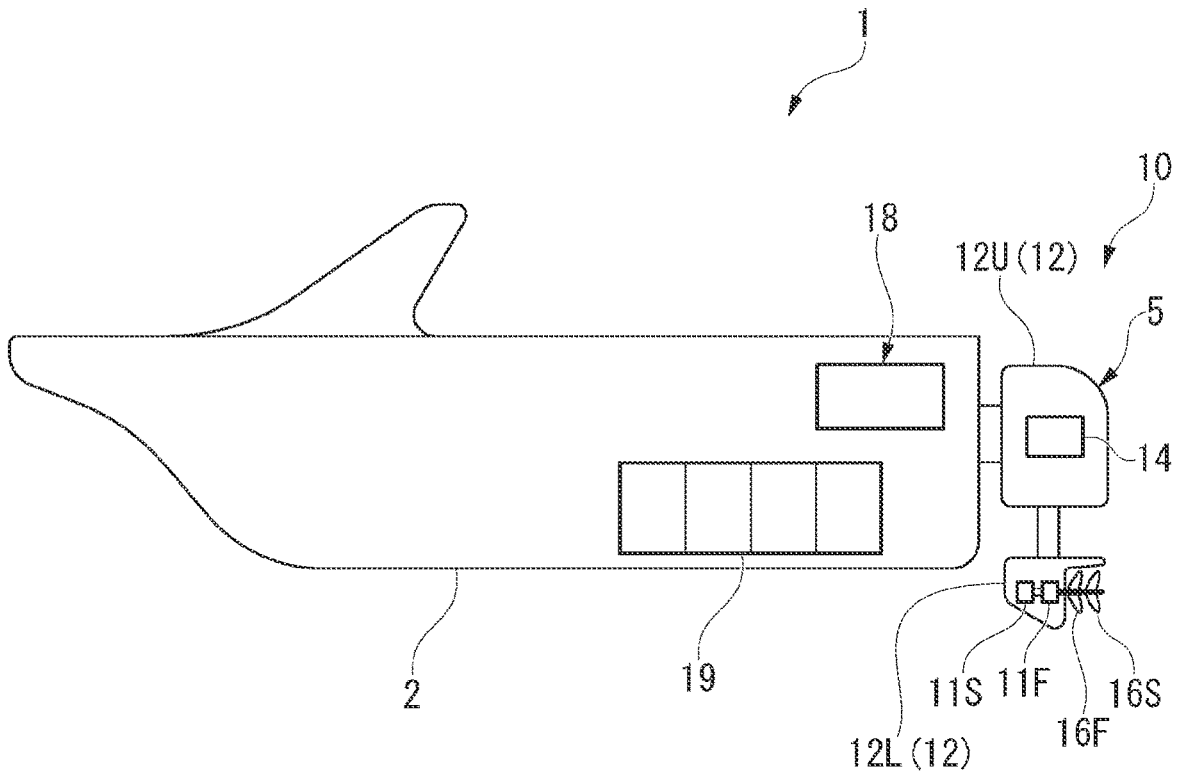
FIG. 1 is a schematic side view of a ship of a first embodiment.
Figure 2:
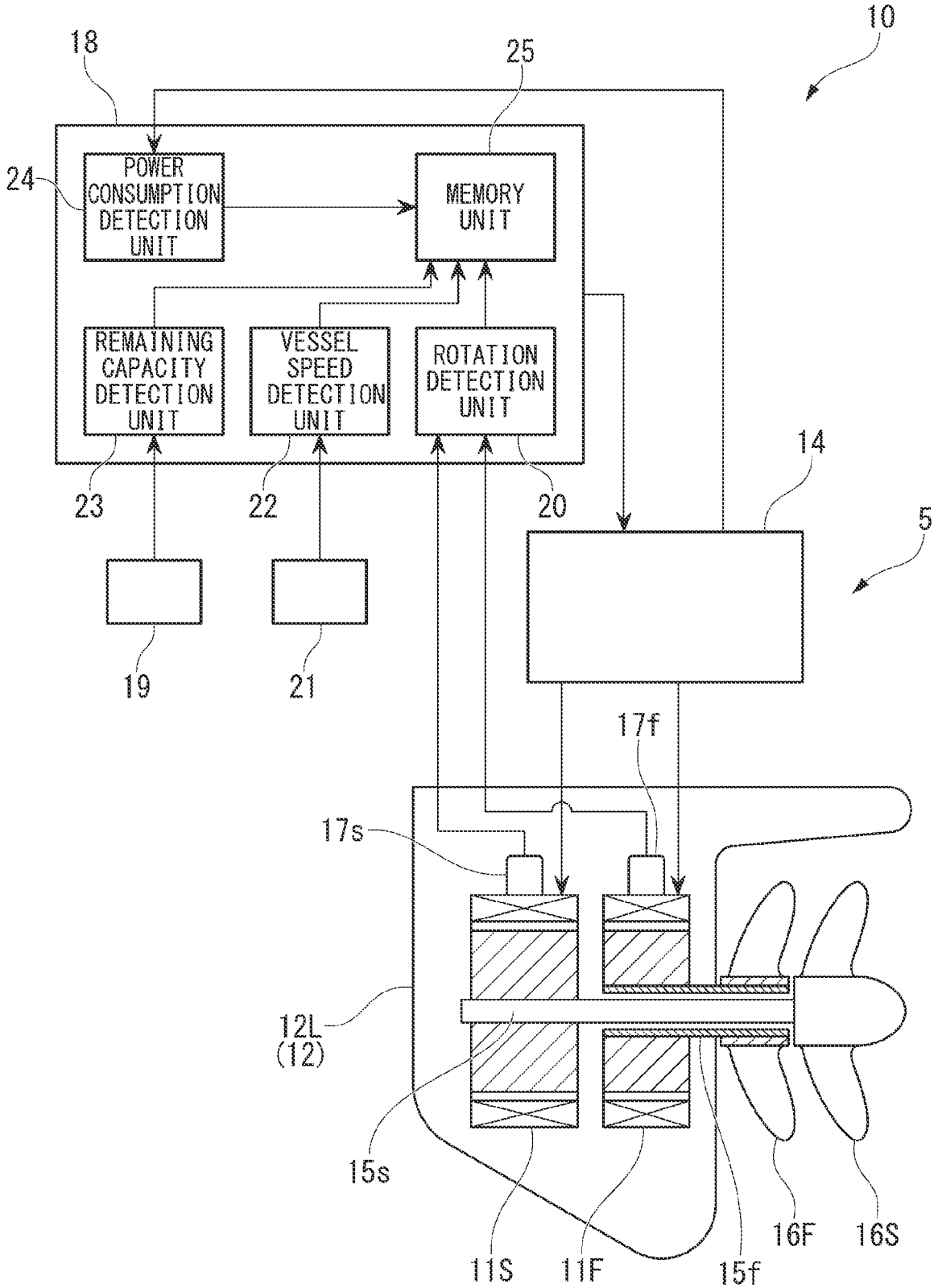
FIG. 2 is a schematic configuration view of a propeller propulsion apparatus of the first embodiment.

FIG. 1 is a schematic side view of a ship 1 that employs a propeller propulsion apparatus 10 of an embodiment. FIG. 2 is a schematic configuration view of the propeller propulsion apparatus 10 of the embodiment.

An outboard motor 5 is attached to a rear part of the hull 2 of the ship 1. The outboard motor 5 is an electric outboard motor, and a first electric motor 11F and a second electric motor 11S are mounted as a driving source. The outboard motor 5 includes an outboard motor case 12 configured to accommodate drive-related parts including the first electric motor 11F and the second electric motor 11S therein. The outboard motor case 12 is supported by a frame member (not shown). The frame member is connected to the rear part of the hull 2 to be pivotable about a tilt shaft (not shown) in an upward/downward direction.

In the following description, "forward" and "rearward" in the outboard motor 5 mean forward and rearward directions in a propulsion direction of the outboard motor 5.

The outboard motor case 12 includes an upper case 12U configured to accommodate a control unit 14 or the like configured to control driving of the first electric motor 11F and the second electric motor 11S, and a lower case 12L configured to accommodate the first electric motor 11F and the second electric motor 11S therein. The lower case 12L is submerged in the sea, rivers, lakes, or the like, during marine navigation of the ship 1.

The first electric motor 11F and the second electric motor 11S are disposed coaxially in the lower case 12L. The first electric motor 11F is disposed behind the second electric motor 11S. Output shafts 15*f* and 15*s* are provided in the first electric motor 11F and the second electric motor 11S, respectively. The output shafts 15*f* and 15*s* extend rearward from the corresponding electric motors 11F and 11S, respectively, and pass through a rear wall of the lower case 12L on a rear side. The output shaft 15*s* of the second electric motor 11S disposed on a front side passes through the first electric motor 11F disposed on the rear side and the output shaft 15*f* thereof in an axial direction. A first propeller 16F is connected to a rear end portion of the output shaft 15*f* passing through the lower case 12L. A second propeller 16S is connected to the lower case 12L and the rear end portion of the output shaft 15*s* of the second electric motor 11S through which the output shaft 15*f* passes.

The first propeller 16F and the second propeller 16S are rotated in opposite directions by the first electric motor 11F and the second electric motor 11S, respectively. The first propeller 16F and the second propeller 16S constitute the contra-rotating propeller. That is, the first propeller 16F and the second propeller 16S collect a swirling flow generated by the first propeller 16F on the front side at the second propeller 16S on the rear side by being rotated in opposite directions, and the driving forces of both the propellers 16F and 16S are efficiently used as propulsion power of the ship 1.

Rotation of the first electric motor 11F and the second electric motor 11S is controlled by the control unit 14. Resolvers 17*f* and 17*s* that are rotation detection units of the electric motors 11F and 11S are provided on the first electric motor 11F and the second electric motor 11S, respectively. Detection signals detected by the resolvers 17*f* and 17*s* are input to an operation control device 18 (integration control device) on the side of the hull 2.

The control unit 14 of the outboard motor 5 receives an order from the operation control device 18 and controls the first electric motor 11F and the second electric motor 11S. In addition, the first electric motor 11F and the second electric motor 11S mounted on the outboard motor 5 are connected to batteries 19 mounted on the hull 2 by electric power cables (not shown).

Further, the batteries 19 may be mounted on not only the hull 2 but also the outboard motor 5. In addition, a part of the function of the operation control device 18 may be performed by another control device mounted on the outboard motor 5.

In addition, while the first electric motor 11F and the second electric motor 11S 5 are controlled by the common control unit 14 in the embodiment, the first electric motor 11F and the second electric motor 11S may be controlled by separate control units.

The operation control device 18 has a rotation detection unit 20 configured to receive rotation signals of the electric motors 11F and 11S from the resolvers 17*f* and 17*s*, and a vessel speed detection unit 22 configured to receive a vessel speed signal from a vessel speed detector 21 such as a vessel speed log or the like. Further, the operation control device 18 has a remaining capacity detection unit 23 configured to receive remaining capacity signals of the batteries 19 from the batteries 19, and a power consumption detection unit 24 configured to receive information of electric power (supplied electric power) consumed by the first electric motor 11F and the second electric motor 11S from the control unit 14 of the outboard motor 5. In addition, the operation control device 18 includes a memory unit 25 configured to receive detection signals from the rotation detection unit 20, the vessel speed detection unit 22, the power consumption detection unit 24, and the like, and stores a combination of rotational frequencies of the first propeller 16F and the second propeller 16S of each vessel speed where a total power consumption of both the electric motors 11F and 11S is an optimum value (for example, a minimum value). The memory unit 25 constitutes the propeller propulsion apparatus 10 together with the first propeller 16F, the second propeller 16S, the first electric motor 11F, the second electric motor 11S, the control unit 14, and the like, on the side of the outboard motor. Further, the optimum value is a value equal to or smaller than a predetermined value that is previously set.

The memory unit 25 may not be disposed in the operation control device 18 or may be disposed outside the operation control device 18. In addition, the memory unit 25 may be disposed on the side of the outboard motor.

Figures 3, 4:
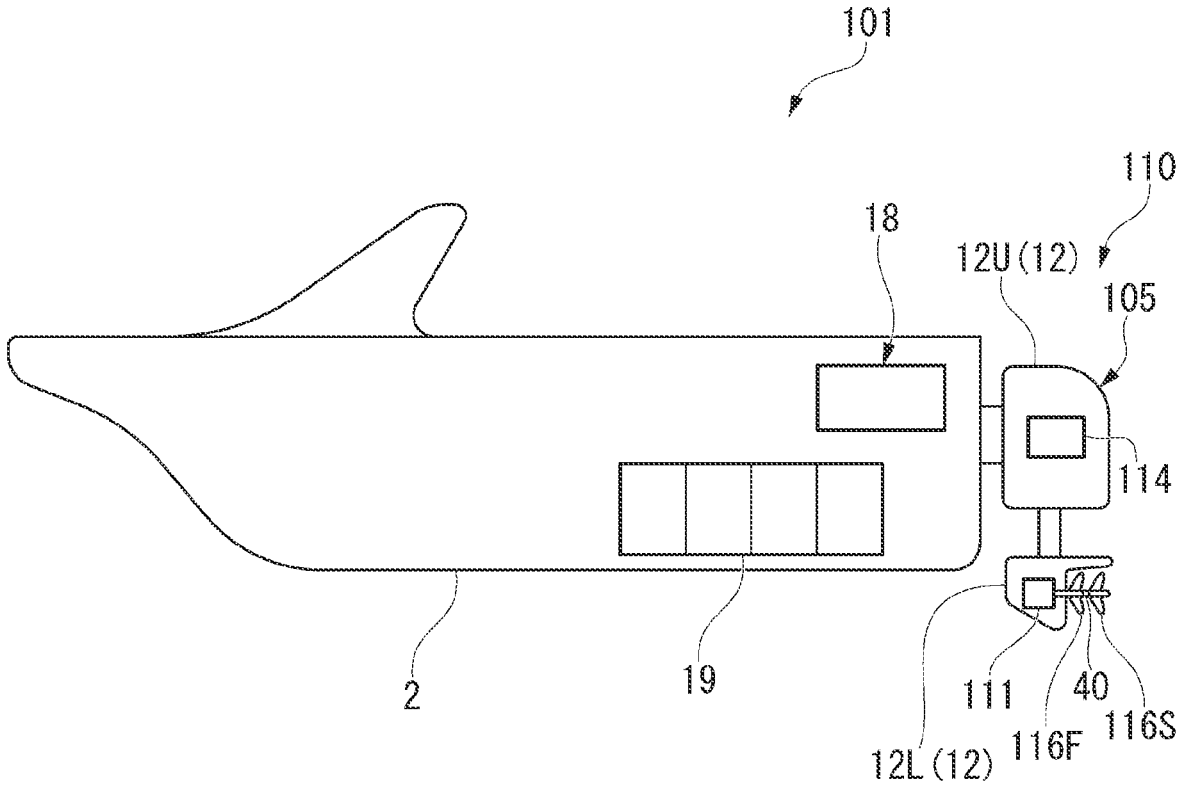
FIG. 3 is a matrix diagram showing a relation between a combination of rotational frequencies of a first propeller and a second propeller for each vessel speed and power consumption.
FIG. 4 is a schematic side view of a ship of a second embodiment.

FIG. 3 is a matrix diagram obtained by performing a calibration operation in the ship 1 and investigating a relation between a combination of rotational frequencies of the first propeller 16F and the second propeller 16S when a vessel speed is 10 km/hour and total power consumption of the first electric motor 11F and the second electric motor 11S. In this case, when a rotational frequency of the first propeller 16F is 1000 revolutions per minute and a rotational frequency of the second propeller 16S is 900 revolutions per minute, the total power consumption of both the electric motors 11F and 11S is minimum 38 kw. Accordingly, in the combination of the rotational frequencies of the first propeller 16F and the second propeller 16S where the total power consumption of both the electric motors 11F and 11S is an optimum value (for example, a minimum value) when the vessel speed is 10 km/hour, the rotational frequency of the first propeller 16F is 1000 revolutions per minute, and the rotational frequency of the second propeller 16S is 900 revolutions per minute.

Upon a calibration operation of the ship 1, similarly, the combination of the rotational frequencies of the first propeller 16F and the second propeller 16S where the total power consumption of both the electric motors 11F and 11S is a minimum value when the vessel speed is 20 km/hour, 30 km/hour, 40 km/hour . . . , is investigated.

As described above, upon the calibration operation, calibration data collected at each vessel speed are stored in the memory unit 25.

Here, upon the calibration operation, an example of the case in which the combination of the rotational frequencies of the first propeller 16F and the second propeller 16S at each vessel speed where the total power consumption of both the electric motors 11F and 11S is an optimum value (for example, minimum value) is stored in the memory unit 25 will be described in detail. However, the memory unit 25 may store the calibration data that further considers the remaining capacity of the batteries 19.

Specifically, upon the calibration operation, the combination of the rotational frequencies of the first propeller 16F and the second propeller 16S of each vessel speed and each remaining battery capacity where the total power consumption of both the electric motors 11F and 11S is the optimum value (for example, minimum value) may be stored in the memory unit 25.

In addition, the operation control device 18 includes a calibration operation mode and a normal operation mode, and each mode thereof can be appropriately switched to perform the operation of the ship 1. The calibration operation mode is an operation mode in which the combination of the rotational frequencies of the first propeller 16F and the second propeller 16S of each vessel speed (or each vessel speed and each remaining battery capacity) where the total power consumption of the first electric motor 11F and the second electric motor 11S is the optimum value (for example, minimum value) is calibrated and stored in the memory unit 25 during the operation of the ship 1. On the other hand, the normal operation mode is an operation mode in which the first electric motor 11F and the second electric motor 11S are controlled by the control unit 14 on the basis of the data of the memory unit 25 such that the total power consumption of the first electric motor 11F and the second electric motor 11S is the optimum value (for example, minimum value) for each vessel speed.

The operation control device 18 appropriately switches the normal operation mode and the calibration operation mode according to an operation situation of the ship 1. The operation control device 18, for example, switches to the calibration operation mode to perform the operation of the ship 1 when there is no safety problem in the operation environment, and performs the marine navigation of the ship 1 in the normal operation mode when there is a safety problem in the operation environment.

In addition, the operation control device 18 switches from the normal operation mode to the calibration operation mode and updates the calibration data of the memory unit 25 when at least one of the first propeller 16F and the second propeller 16S is replaced.

The operation control device 18 may periodically switch from the normal operation mode to the calibration operation mode. For example, when the ship 1 performs marine navigation over a certain distance, the normal operation mode may be switched to the calibration operation mode to update the calibration data of the memory unit 25. In addition, when the ship 1 performs marine navigation for a certain period of time (period) or longer, the normal operation mode may be switched to the calibration operation mode to update the calibration data of the memory unit 25.

As described above, the propeller propulsion apparatus 10 of the embodiment includes the memory unit 25 configured to store the combination of the rotational frequencies of the first propeller 16F and the second propeller 16S at each vessel speed where the total power consumption of the first electric motor 11F and the second electric motor 11S is the optimum value (for example, minimum value) during the calibration operation of the ship 1. Then, during the normal operation of the ship 1, the control unit 14 controls the first electric motor 11F and the second electric motor 11S on the basis of the data stored in the memory unit 25 such that the total power consumption is the optimum value at each vessel speed.

Accordingly, when the propeller propulsion apparatus 10 of the embodiment is employed, it is possible to efficiently use the driving force of the first electric motor 11F and the second electric motor 11S regardless of the vessel speed of the ship 1. Accordingly, power consumption of the batteries 19 can be reduced, and a marine navigation distance of the ship 1 can be lengthened.

In addition, the propeller propulsion apparatus 10 of the embodiment has the operation control device 18 configured to control the operation of the ship 1, and the operation control device 18 has a calibration operation mode and a normal operation mode. In the calibration operation mode, the combination of the rotational frequencies of the first propeller 16F and the second propeller 16S at each vessel speed where the total power consumption of the first electric motor 11F and the second electric motor 11S is the optimum value (for example, minimum value) is calibrated and stored in the memory unit 25. Then, the operation control device 18 is appropriately switched to the normal operation mode and the calibration operation mode according to the operation situation of the ship 1. For this reason, for example, it is possible to be switched from the normal operation mode to the calibration operation mode when there is no safety problem in the operation environment even though the calibration driving of the ship 1 is performed.

Accordingly, when the configuration is employed, while ensuring the safe operation of the ship 1, it is possible to collect the calibration data of the combination of the rotational frequencies of the first propeller 16F and the second propeller 16S.

Further, in the propeller propulsion apparatus 10 of the embodiment, when at least one of the first propeller 16F and the second propeller 16S is replaced, the operation control device 18 switches the operation mode of the ship 1 from the normal operation mode to the calibration operation mode. For this reason, it is possible to be switched to the calibration operation mode at timing when at least one of the first propeller 16F and the second propeller 16S is replaced. Accordingly, when the configuration is employed, even though the combination of the rotational frequencies of the first propeller 16F and the second propeller 16S where the total power consumption of the first electric motor 11F and the second electric motor 11S is the optimum value due to replacement of the propeller is changed, the normal operation can be performed by changing the calibration data of the combination of the rotational frequency to the latest one.

In addition, in the propeller propulsion apparatus 10 of the embodiment, the operation control device 18 is periodically switched from the normal operation mode to the calibration operation mode. For this reason, the normal operation can be performed by normally changing the calibration data of the combination of the rotational frequencies of the first propeller 16F and the second propeller 16S to the latest one.

Further, in the case of the embodiment in which the combination of the rotational frequencies of the first propeller 16F and the second propeller 16S at each vessel speed and each remaining battery capacity where the total power consumption of both the electric motors 11F and 11S is the optimum value (for example, minimum value) is stored in the memory unit 25 during the calibration operation, the following effects can be obtained.

In the case of the embodiment, during the normal operation of the ship 1, the first electric motor 11F and the second electric motor 11S are respectively controlled such that the total power consumption is the optimum value (for example, minimum value) on the basis of the data corresponding to the vessel speed and the remaining battery capacity, which are stored in the memory unit 25 in advance. Accordingly, when the propeller propulsion apparatus 10 of the embodiment is employed, it is possible to efficiently use the driving force of the first electric motor 11F and the second electric motor 11S regardless of the vessel speed of the ship 1 or the remaining capacity of the batteries 19. In particular, when the remaining capacity of the batteries 19 is small, the marine navigation distance of the ship 1 can be further lengthened.

Second Embodiment

Figure 5:
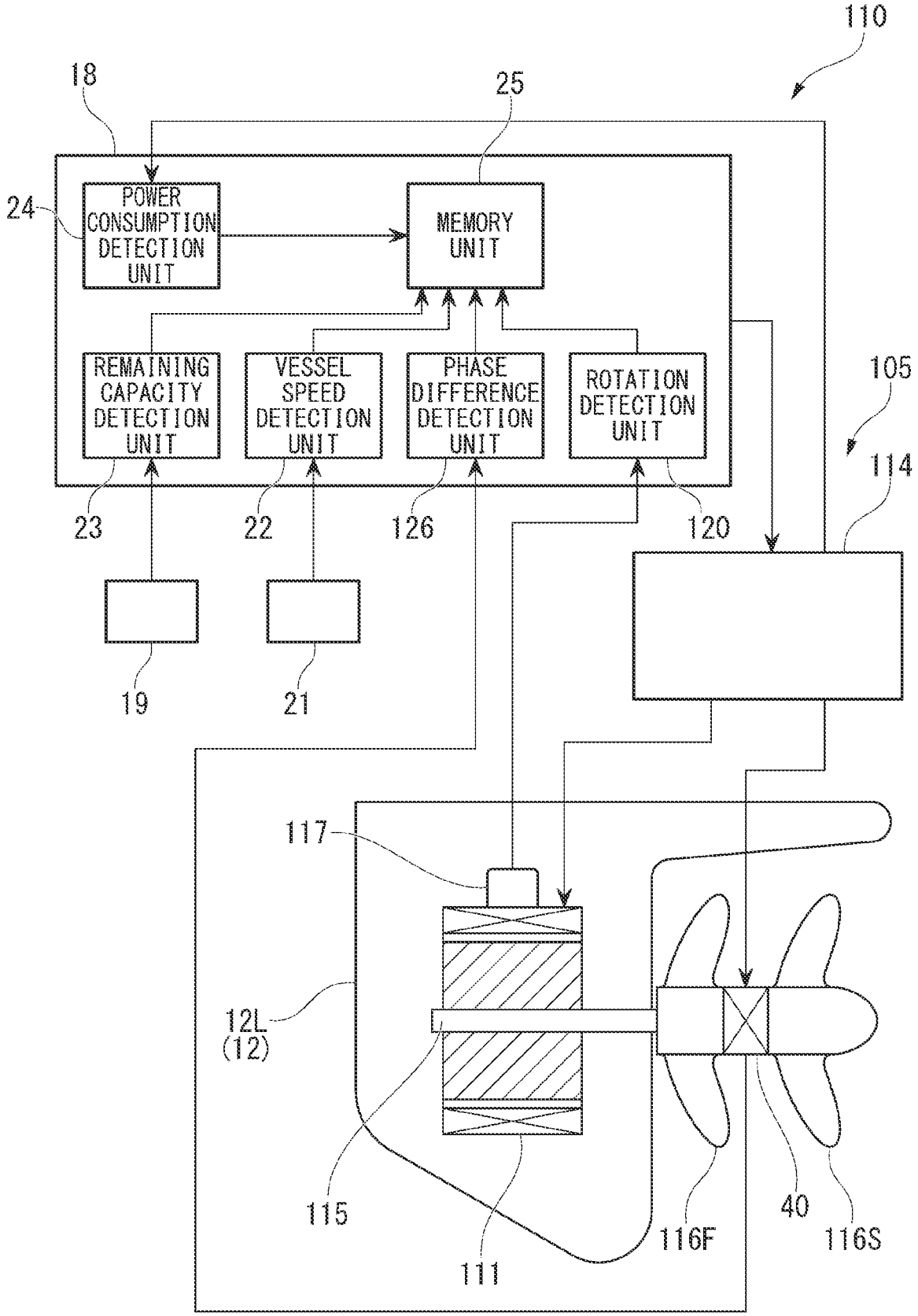
FIG. 5 is a schematic configuration view of propeller propulsion apparatus of the second embodiment.

FIG. 4 is a schematic side view of the ship 1 that employs a propeller propulsion apparatus 110 of an embodiment. FIG. 5 is a schematic configuration view of the propeller propulsion apparatus 110 of the embodiment.

An outboard motor 105 attached to the rear part of the hull 2 is an electric outboard motor, in which an electric motor 111 is mounted as a driving source. The outboard motor 105 includes the same outboard motor case 12 as in the embodiment. The electric motor 111 is accommodated in the lower case 12L of the outboard motor case 12. A control unit 114 configured to control the electric motor 111 is accommodated in the upper case 12U of the outboard motor case 12.

An output shaft 115 is provided in the electric motor 111. The output shaft 115 extends rearward from the electric motor 111 and passes through a rear wall of the lower case 12L rearward. A first propeller 116F and a second propeller 116S are connected to a rear end portion of the output shaft 115 passing through the lower case 12L. The first propeller 116F and the second propeller 116S are disposed coaxially such that mutual rotation phases are shifted by a predetermined angle. The second propeller 116S is disposed behind the first propeller 116F. The first propeller 116F and the second propeller 116S constitute the double propeller in which the second propeller 116S on the rear side rectifies the swirling flow generated by the first propeller 116F due to the shift of the mutual rotation phases.

Figure 6:
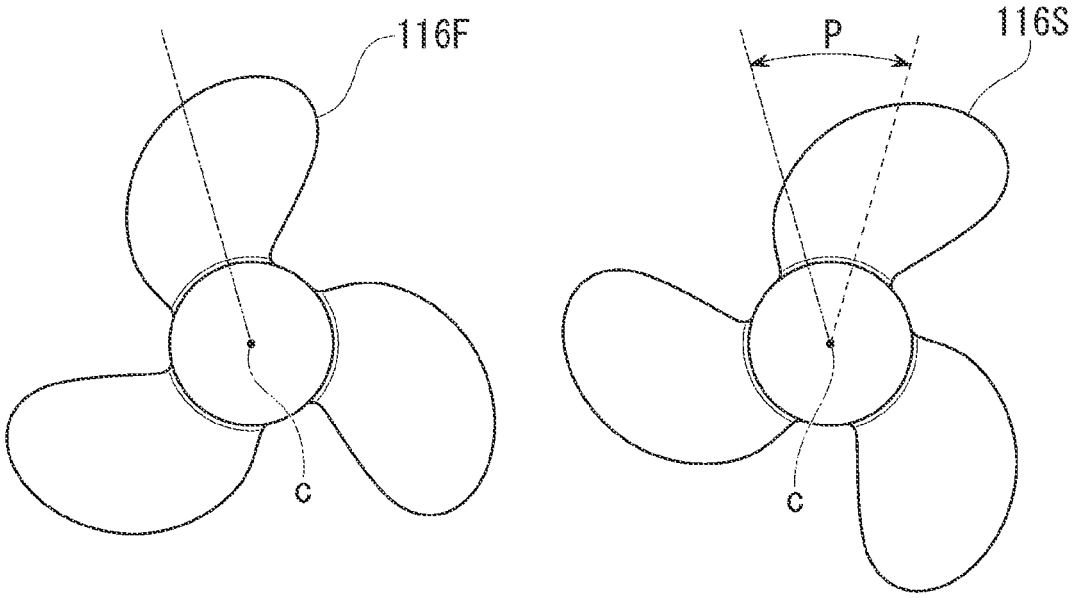
FIG. 6 is a front view of a first propeller and a second propeller of the propeller propulsion apparatus of the second embodiment.

FIG. 6 is a front view of the first propeller 116F and the second propeller 116S.

In FIG. 6, the first propeller 116F and the second propeller 116S are shifted by an angle P in rotation phase around a rotation center axis c. As shown in FIG. 4 and FIG. 5, a phase operation actuator 40 constituted by an electric motor, a hydraulic actuator, or the like, is disposed between the first propeller 116F and the second propeller 116S. The phase operation actuator 40 can adjust a rotation phase difference P between the first propeller 116F and the second propeller 116S to an arbitrary angle by actuation of the actuator.

Rotation of the electric motor 111 and actuation of the phase operation actuator 40 are controlled by the control unit 114. A resolver 117 is provided on the electric motor 111. In addition, an actuation detection sensor (not shown) is provided on the phase operation actuator 40. Signals detected by the resolver 117 and the actuation detection sensor are input to the operation control device 18 (integration control device) on the side of the hull 2.

The control unit 114 of the outboard motor 105 receives an order from the operation control device 18 and controls the electric motor 111 and the phase operation actuator 40. The electric motor 111 on the side of the outboard motor 105 is connected to the batteries 19 mounted on the hull 2 by electric power cables (not shown).

Even in the case of the embodiment, the batteries 19 may be mounted on not only the hull 2 but also the outboard motor 5. In addition, a part of the function of the operation control device 18 may be performed by another control device mounted on the outboard motor 5.

The operation control device 18 has a rotation detection unit 120 configured to receive a rotation signal from the resolver 117 of the electric motor 111, and a phase difference detection unit 126 configured to receive a detection signal from the actuation detection sensor of the phase operation actuator 40. Further, the operation control device 18 has the vessel speed detection unit 22 configured to receive a vessel speed signal from the vessel speed detector 21 such as a vessel speed log or the like, the remaining capacity detection unit 23 configured to receive a remaining capacity signal of the batteries 19 from the batteries 19, and the power consumption detection unit 24 configured to receive information of the electric power (supplied electric power) consumed by the electric motor 111 from the control unit 14 of the outboard motor 5.

The operation control device 18 includes the memory unit 25 configured to receive detection signals from the rotation detection unit 120, the phase difference detection unit 126, the vessel speed detection unit 22, the power consumption detection unit 24, and the like, and stores the rotation phase difference between the first propeller 116F and the second propeller 116S at each vessel speed where the power consumption of the electric motor 111 is the optimum value (for example, minimum value).

The memory unit 25 constitutes the propeller propulsion apparatus 110 together with the first propeller 116F, the second propeller 116S, the electric motor 111, the phase operation actuator 40, the control unit 114, and the like, on the side of the outboard motor. Even in the case of the embodiment, the memory unit 25 may be disposed outside the operation control device 18.

In the embodiment, during the calibration operation of the ship 1, the rotation phase difference between the first propeller 116F and the second propeller 116S at each vessel speed where the power consumption of the electric motor 111S is the optimum value (for example, minimum value) is stored in the memory unit 25. However, the memory unit 25 may store the calibration data in further consideration of the remaining capacity of the batteries 19.

Specifically, during the calibration operation, the rotation phase difference between the first propeller 116F and the second propeller 116S at each vessel speed and each remaining battery capacity where the power consumption of the electric motor 111 is the optimum value (for example, minimum value) may be stored in the memory unit 25.

Even in the case of the operation control device 18 of the embodiment, like the above-mentioned embodiment, a normal operation mode and a calibration operation mode are provided. Here, the normal operation mode and the calibration operation mode are switched under the same condition or timing as the embodiment.

As described above, in the propeller propulsion apparatus 110 of the embodiment, during the normal operation of the ship, the control unit 114 controls the phase operation actuator 40 on the basis of the data of the rotation phase difference at each vessel speed stored in the memory unit 25.

Accordingly, when the propeller propulsion apparatus 110 of the embodiment is employed, the driving force of the electric motor 111 can be efficiently used regardless of the vessel speed of the ship 1. Accordingly, the power consumption of the batteries 19 can be reduced, and the marine navigation distance of the ship 1 can be lengthened.

In addition, in the propeller propulsion apparatus 110 of the embodiment, the operation control device 18 has a calibration operation mode and a normal operation mode. In the calibration operation mode, the rotation phase difference between the first propeller 116F and the second propeller 116S at each vessel speed where the power consumption of the electric motor 111 is the optimum value (for example, minimum value) is calibrated and stored in the memory unit 25. Then, the operation control device 18 is appropriately switched between the normal operation mode and the calibration operation mode according to the operation situation of the ship 1. For this reason, even in the case of the embodiment, for example, when there is no safety problem in operation environment even if the calibration driving of the ship 1 is performed, it is possible to be switched from the normal operation mode to the calibration operation mode. Accordingly, it is possible to collect the calibration data of the rotation phase difference between the first propeller 116F and the second propeller 116S while ensuring a safety operation of the ship 1.

In addition, during the calibration operation, when the rotation phase difference between the propellers 16F and 16S at each vessel speed and each remaining battery capacity where the power consumption of the electric motor 111 is the optimum value (for example, minimum value) is stored in the memory unit 25, it is possible to efficiently use the driving force of the electric motor 111 regardless of the vessel speed of the ship 1 or the remaining capacity of the batteries 19.

The present invention is not limited to the above-mentioned embodiments and various design changes may be made without departing from the spirit of the present invention.

For example, while the example in which the combination of the rotational frequencies of the first propeller 16F and the second propeller 16S at each vessel speed where the total power consumption of the first electric motor 11F and the second electric motor 11S is the minimum value is stored in the memory unit 25 has been exemplified in the first embodiment, the optimum value of the total power consumption may not be the minimum value. For example, if the total power consumption is sufficiently small, the combination of the rotational frequencies of the first propeller 16F and the second propeller 16S that satisfies another preferable condition may be stored in the memory unit 25 as an optimum value.

Similarly, even in the case of the second embodiment, the optimum value of the power consumption of the electric motor 111 may be not the minimum value.

In addition, while the outboard motor type has been exemplified as the propeller propulsion apparatus in each of the embodiments, a propulsion type of the propeller propulsion apparatus is not limited thereto. The propulsion type of the propeller propulsion apparatus may be, for example, an inboard-outdrive engine type or a pod drive type.

BRIEF DESCRIPTION OF THE REFERENCE SYMBOLS

1: Ship
10: Propeller propulsion apparatus
11F: First electric motor
11S: Second electric motor
14: Control unit
16F: First propeller
16S: Second propeller
18: Operation control device
19: Battery
23: Remaining capacity detection unit
25: Memory unit
40: Phase operation actuator
110: Propeller propulsion apparatus
111: Electric motor
114: Control unit
116F: First propeller
116S: Second propeller

What is claim is:

1. A propeller propulsion apparatus for a ship comprising:
a first propeller;
a second propeller disposed coaxially with the first propeller and rotating in a direction opposite to the first propeller;
a first electric motor configured to drive the first propeller;
a second electric motor configured to drive the second propeller;
a control unit configured to control each of the first electric motor and the second electric motor; and
a memory unit configured to store a combination of rotational frequencies of the first propeller and the second propeller at each vessel speed where total power consumption of the first electric motor and the second electric motor is an optimum value,
wherein the control unit controls the first electric motor and the second electric motor on the basis of the data of the memory unit such that the total power consumption at each vessel speed is the optimum value during operation of a ship.

2. The propeller propulsion apparatus for a ship according to claim 1, wherein the optimum value is a value equal to or smaller than a previously set threshold.

3. The propeller propulsion apparatus for a ship according to claim 1, further comprising an operation control device configured to control the operation of the ship,
wherein the operation control device has:
a calibration operation mode of calibrating the combination of the rotational frequencies of the first propeller and the second propeller at each vessel speed where the total power consumption is an optimum value and storing the combination in the memory unit; and
a normal operation mode of causing the control unit to control the first electric motor and the second electric motor on the basis of the data of the memory unit such that the total power consumption is an optimum value at each vessel speed, and
the operation control device is switched between the normal operation mode and the calibration operation mode according to an operation situation of the ship.

4. The propeller propulsion apparatus for a ship according to claim 2, further comprising an operation control device configured to control the operation of the ship,
wherein the operation control device has:
a calibration operation mode of calibrating the combination of the rotational frequencies of the first propeller and the second propeller at each vessel speed where the total power consumption is an optimum value and storing the combination in the memory unit; and
a normal operation mode of causing the control unit to control the first electric motor and the second electric motor on the basis of the data of the memory unit such that the total power consumption is an optimum value at each vessel speed, and
the operation control device is switched between the normal operation mode and the calibration operation mode according to an operation situation of the ship.

5. The propeller propulsion apparatus for a ship according to claim 3, wherein the operation control device is switched from the normal operation mode to the calibration operation mode when at least one of the first propeller and the second propeller is replaced.

6. The propeller propulsion apparatus for a ship according to claim 4, wherein the operation control device is switched from the normal operation mode to the calibration operation mode when at least one of the first propeller and the second propeller is replaced.

7. The propeller propulsion apparatus for a ship according to claim 3, wherein the operation control device is periodically switched from the normal operation mode to the calibration operation mode.

8. The propeller propulsion apparatus for a ship according to claim 4, wherein the operation control device is periodically switched from the normal operation mode to the calibration operation mode.

9. The propeller propulsion apparatus for a ship according to claim 5, wherein the operation control device is periodically switched from the normal operation mode to the calibration operation mode.

10. The propeller propulsion apparatus for a ship according to claim 6, wherein the operation control device is periodically switched from the normal operation mode to the calibration operation mode.

11. A propeller propulsion apparatus for a ship comprising:
a first propeller;
a second propeller disposed coaxially with the first propeller and rotating in a direction opposite to the first propeller;
a first electric motor configured to drive the first propeller;
a second electric motor configured to drive the second propeller;
a battery configured to supply electric power to the first electric motor and the second electric motor;
a control unit configured to control the first electric motor and the second electric motor; and
a memory unit configured to store a combination of rotational frequencies of the first propeller and the second propeller at each vessel speed and a remaining capacity of the battery where total power consumption of the first electric motor and the second electric motor is an optimum value;

wherein the control unit controls the first electric motor and the second electric motor on the basis of the data of the memory unit such that the total power consumption is an optimum value at each vessel speed and remaining capacity of the battery during operation of a ship.

12. The propeller propulsion apparatus for a ship according to claim 11, wherein the optimum value is a value equal to or smaller than a previously set threshold.

13. A propeller propulsion apparatus for a ship comprising:

a first propeller;

a second propeller disposed coaxially with the first propeller and synchronizedly rotated in the same direction as the first propeller;

an electric motor configured to drive the first propeller and the second propeller;

a phase operation actuator configured to adjust a rotation phase difference between the first propeller and the second propeller;

a control unit configured to control the electric motor and the phase operation actuator; and a memory unit configured to store a rotation phase difference between the first propeller and the second propeller at each vessel speed where power consumption of the electric motor is an optimum value, wherein the control unit controls the phase operation actuator on the basis of data of the memory unit such that the power consumption is an optimum value at each vessel speed during an operation of a ship.

14. The propeller propulsion apparatus for a ship according to claim 13, wherein the optimum value is a value equal to or smaller than a previously set threshold.

15. The propeller propulsion apparatus for a ship according to claim 13, further comprising an operation control device configured to control an operation of the ship, wherein the operation control device has:

a calibration operation mode of storing a rotation phase difference between the first propeller and the second propeller at each vessel speed where power consumption of the electric motor is an optimum value in the memory unit; and a normal operation mode of causing the control unit to control the phase operation actuator on the basis of data of the memory unit such that the power consumption is the optimum value at each vessel speed, and the operation control device is switched between the normal operation mode and the calibration operation mode according to an operation situation of the ship.

16. The propeller propulsion apparatus for a ship according to claim 14, further comprising an operation control device configured to control an operation of the ship, wherein the operation control device has:

a calibration operation mode of storing a rotation phase difference between the first propeller and the second propeller at each vessel speed where power consumption of the electric motor is an optimum value in the memory unit; and a normal operation mode of causing the control unit to control the phase operation actuator on the basis of data of the memory unit such that the power consumption is the optimum value at each vessel speed, and the operation control device is switched between the normal operation mode and the calibration operation mode according to an operation situation of the ship.

* * * * *